United States Patent [19]

Anfosso et al.

[11] Patent Number: 4,832,265

[45] Date of Patent: May 23, 1989

[54] PERFORATOR-INJECTOR WITH AN INTERNAL PERCUSSION MASS

[75] Inventors: Roger Anfosso, Toulon; Evrard Borg, Sanary Sur Mer; Jean-René Douté, Stains; Charles Zwiller, Villabe; Jean-Pierre Gouallec, Toulon, all of France

[73] Assignee: Societe Nationale Des Poudres Et Explosifs, Paris Cedex, France

[21] Appl. No.: 932,018

[22] Filed: Nov. 18, 1986

[30] Foreign Application Priority Data

Nov. 19, 1985 [FR] France ..... 85 17038

[51] Int. Cl.[4] ..... A62C 31/22

[52] U.S. Cl. ..... 239/271; 169/70; 227/9

[58] Field of Search ..... 239/271, 276; 169/70; 227/9, 10

[56] References Cited

U.S. PATENT DOCUMENTS

| | | | |
|---|---|---|---|
| 2,920,563 | 1/1960 | De Caro | 227/9 |
| 3,249,279 | 5/1966 | Behrend et al. | 227/10 |
| 3,261,528 | 7/1966 | De Courteix | 227/9 |
| 3,575,332 | 4/1971 | Brunelle | 227/10 |
| 3,645,091 | 2/1972 | Nanov et al. | 227/10 |
| 4,056,935 | 11/1977 | Gassmann | 227/10 |
| 4,358,041 | 11/1982 | Ollivier | 227/9 |
| 4,493,376 | 1/1985 | Kopf | 227/10 |

FOREIGN PATENT DOCUMENTS

| | | | |
|---|---|---|---|
| 2070928 | 9/1981 | United Kingdom | 239/276 |

*Primary Examiner*—Andres Kashnikow
*Assistant Examiner*—Michael J. Forman
*Attorney, Agent, or Firm*—Bucknam and Archer

[57] ABSTRACT

A device capable of perforating strong walls, then of injecting a fluid through the same walls, is described. The device is intended essentially for intervention crews such as personnel assigned to maintain order or fire-fighters. The perforator-injector has a piston (1) which can be displaced in a cylinder (2,3) under the influence of a power fluid under high pressure. In order to increase the perforating power without inducing a too great initial recoil, the perforator-injector is equipped with a percussion mass (4) which is interposed between the head (1*b*) of the piston and a source of power fluid under high pressure. This mass is initially kept at a distance from the head of the piston and is capable of sliding in the cylinder (2,3).

7 Claims, 1 Drawing Sheet

PERFORATOR-INJECTOR WITH AN INTERNAL PERCUSSION MASS

Figure 1:
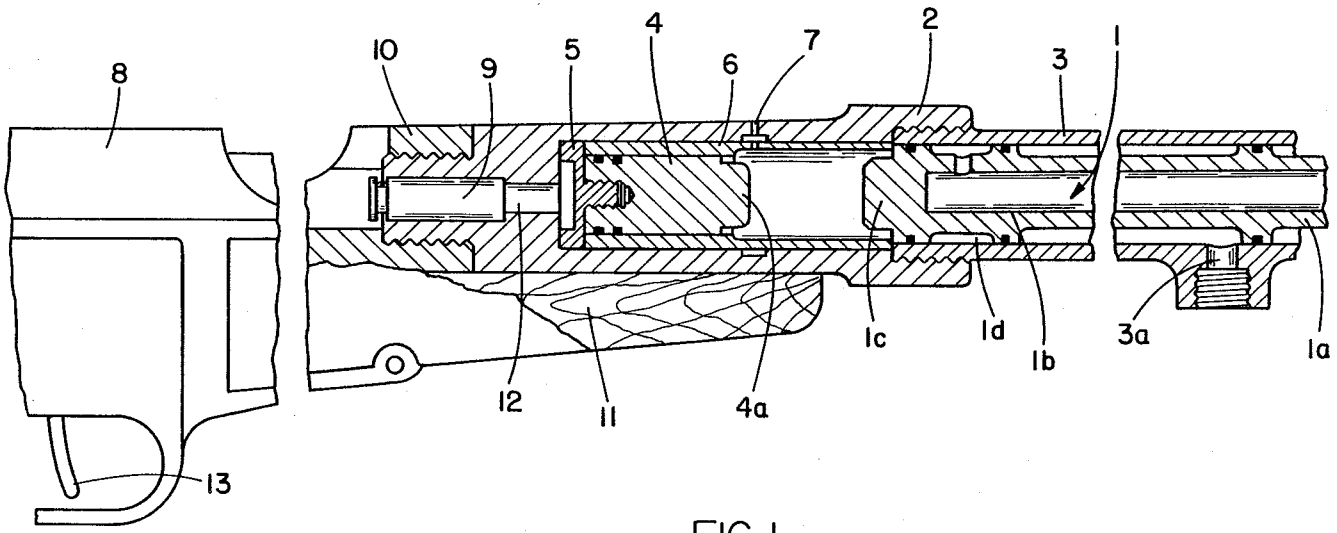

This invention relates to a device capable of perforating strong walls and injecting a fluid through these walls. The device is intended primarily for intervention crews such as personnel assigned to maintain order or firefighters.

In many cases in which a very fast intervention is required, it may be helpful to be able to inject an active fluid through a strong wall such as a building partition or a closed door. This can be the case, for example, when it is necessary to neutralize people barricaded in a room or in an aircraft cockpit, by injection of a fluid having immediate physiological action, or to fight a fire confined to a determined room, by injection of an extinguishing fluid.

Equipment such as described in the French Pat. No. 2,477,423 and now available to intervention personnel permits, successively, but almost instantaneously, the perforation of a strong wall, then the injection of an active fluid through this wall, by the use of a portable, easy to handle, dependable device which is absolutely safe for the user. However, when the perforator-injector is held manually and triggered on contact with a too strong wall which cannot be punctured, the thrust of the gases is not stopped and the moving part of the perforator, which is blocked in contact with the wall, then serves as a support and the perforator-injector unit is thrown backward.

These known perforator-injectors, and more particularly the device described in the French Pat. No. 2,477,423 comprise:

on one hand a piston which is placed in a cylinder defining a power chamber situated upstream of this piston and which is fed by a power fluid under high pressure, with a piston rod situated downstream which can slide in the downstream part of the cylinder, the piston rod being tubular and forming an injection channel, and on the other hand a cylinder with an opening admitting active fluid, which communicates with the intake duct only when the piston is substantially in abutment on the downstream part of the cylinder.

An object of the present invention is to increase the perforating power, without raising the pressure and/or the flow of the high pressure power fluid, which could lead to an excessively abrupt recoil endangering the operator. Further, when the power fluid is generated by a pyrotechnic charge, it is advantageous to limit the quantity of powder used and to induce a substantially constant initial recoil regardless of the result on the wall to be punctured.

The invention is characterized by the fact that a percussion mass is interposed between the head of the piston and a source of power fluid under high pressure, this mass initially being kept at a distance from the head of the piston and being able to slide in the cylinder.

More particularly, on one hand the percussion mass is cylindrical and has a diameter substantially equal to the diameter of the head of the piston, and on the other hand the ratio (PM//PP) between the weight (PM) of the percussion mass and the weight (PP) of the complete piston is comprised between 0.1 and 0.8, and preferably between 0.2 and 0.4. It has been observed, as a matter of fact, that percussion masses of small diameter such as the diameter of a bullet, even one of high caliber, could not increase the perforating power of the perforator-injector, without increasing the propellant charge of the powder.

Advantageously on one hand, the upstream end of the percussion mass has a frangible positioning element which permits a more efficient pressure increase in the part of the power chamber situated further upstream, and on the other hand an internal ferrule is interposed between the percussion mass and the upstream part of the cylinder which has a chambering in its downstream zone in communication with the outside through orifices. The internal ferrule can, for example, constitute a positioning brace for a piston relative to the percussion mass.

According to a particular embodiment, the downstream zone of the percussion mass and the upstream zone of the head of the piston have a diameter smaller than the inner diameter of the internal ferrule, a fact which facilitates the expulsion of the air comprised between the percussion mass and the head of the piston, and permits reuse of these components even after several mutual impacts.

Advantageously, the cylinder constitutes a special gun barrel and the zone of the power chamber which is the most upstream has a chambering accommodating a gas generating cartridge.

The advantages obtained according to the present invention consist, essentially of the following:

on one hand the recoil effect is diminished, the more so because it is now possible to reduce the outside diameter of the perforator-injector sufficiently so that it can be actuated from the shoulder, and, on the other hand, the perforating power is increased substantially when the percussion mass has a frangible positioning element of sufficient strength and the upstream part of the cylinder has exhaust orifices.

The invention will now be described in more detail by reference to the drawing, the single FIGURE representing a particular mode of execution.

The FIGURE illustrates a perforator-injector which constitutes a special barrel mounted on the single-shot gun (8), of which only the distal part is shown in part. The special barrel is constituted on the outside by the two parts of the perforator-injector cylinder, the upstream part (2) of the cylinder being screwed into the metallic body (10) of the gun and being encased within the wooden stock (11) of the gun. The downstream part (3) of the cylinder is screwed to the free end of the upstream part (2) and has an embossment in which is formed the intake opening (3*a*) of the active fluid which is prolonged on the outside by a thread for connection to a flexible tube feeding the active fluid. The piston (1), the head of which (1*b*) can slide in the downstream part (3) of the cylinder, is initially held pressed on the internal ferrule (6) which constitutes a brace between the positioning disc (5) and the downstream part (3) of the cylinder. The internal ferrule (6) has a chambering downstream of the end of the percussion mass (4) and three radial perforations which start from the bottom of this chambering and open into an annular groove formed in the upstream part (2) of the cylinder which is provided with three orifices (7) for the escape of air and combustion gases. The positioning disc (5) has a circular scoring to facilitate the shearing of this disc, the downstream central part of which is screwed into the percussion mass (4) and the upsteam central part of which is recessed opposite the flame tube (12) which terminates upstream in a chambering which permits accommodation of a gas generating cartridge (9).

In operation, after introducing a brass gas-generating cartridge containing 1 gram of nitrocellulose-base powder in the accommodation of the special barrel, and after reclosing the breech and cocking the trigger system, a simple pressure on the detente tail (13) permits the immediate actuation of the perforator-injector. The gases generated following the central percussion of the cartridge base are ejected through the flame tube (12) into the power chamber and produce the shearing of the positioning disc (5) with a delay on the order of 1 millisecond. The percussion mass (4) the weight of which is 150 g, is then accelerated like a shell and its displacement downstream compresses and drives out the air initially situated between this mass and the upstream zone (1*c*) of the head of the piston toward the chambering of the internal ferrule (6) and toward the escape orifices (7), the rise in pressure of this air priming the displacement of the piston downstream. When the downstream zone of the percussion mass strikes the head of the piston, the kinetic energy of this mass is transmitted to the piston, the tubular rod of which perforates the wall on which the perforator-injector is applied, and as soon as the groove (1*d*) of the head of the piston uncovers the intake opening (3*a*), the active fluid is diffused from the other side of the wall. This active fluid may be not only a liquid or a gas, but also a powder of very small granulometry.

When a percussion mass is used according to the invention, the recoil effect of the gun felt by the operator is much more limited and more constant since this recoil results, practically speaking, only from the combustion of the cartridge (9) and is independent of the conditions of perforation of the wall, or eventually of the total non-perforation. As a matter of fact, the injection of the piston is obtained by the impact of the percussion mass (4) and therefore by transmission of the kinetic energy of this mass to the piston, and this ejection is not obtained directly by the pressure of the combustion gases on this piston, because the power chamber containing the gases under high pressure is brought into communication with the escape orifices (7) slightly before or slightly after the percussion mass (4) strikes the head (1*b*) of the piston.

In the course of comparative tests during which the same piston and the same gas-generating cartridge was used, it was always possible to perforate, simultaneously, a sheet of tempered steel 2 millimeters thick and a plank of wood agglomerate 40 millimeters thick with the use of a percussion mass weighing 150 g, while the mere use of a power chamber without a percussion mass never allowed the piston rod to pass entirely through a single sheet of tempered steel 2 millimeters thick and only the pyramidal point of this rod penetrated the steel sheet.

What is claimed is:

1. A device for perforating a strong wall and for injecting an active fluid through said wall, comprising:

a cylinder having an upstream part (2) and a downstream part (3), said upstream part defining a power chamber capable of being fed by a power fluid delivered from a source of power fluid under high pressure, a downstream part (3) having an opening (3*a*) for admission of said active fluid, said upstream part (2) being provided with orifices (7) for the escape of air and combustion gases, combustion gases, a piston (1) placed in said cylinder (2, 3), said piston comprising a tubular rod (1*a*) forming an injection channel and a head (1*b*), said head (1*b*) having an upstream zone (1*c*), said tubular rod (1*a*) being capable of sliding in the downstream part (3) of the cylinder, whereby said opening (3*a*) communicates with said rod (1*a*) only when said piston (1) slides and is substantially in abutment on the end of said downstream part (3) of said cylinder (3), a percussion mass (4) having an upstream end, said upstream end having a frangible positioning element, said percussion mass having a downstream zone (4*a*) interposed between said head (1*b*) of said piston and the source of high pressure power fluid, said mass being initially kept at a distance from the head (1*b*) of the piston and being able to slide in said cylinder (2, 3), wherein an internal ferrule (6) surrounds said percussion mass and is interposed between said percussion mass (4) and said upstream part (2) of the cylinder, said ferrule (6) having an enlarged chambering downstream of the downstream zone (4*a*) of said percussion mass (4) with perforations which communicate with said orifices (7).

2. The device according to claim 1 wherein the ratio (PM/PP), between the weight (PM) of said percussion mass (4) and the weight (PP) of the said piston (1) is between 0.1 and 0.8.

3. The device according to claim 2 wherein said ratio (PM/PP) is between 0.2 and 0.4.

4. The device according to claim 1 wherein said piston (1) is initially held pressed on said internal ferrule (6).

5. The device according to claim 1 wherein the internal ferrule has an inner diameter, the downstream zone (4*a*) of the percussion mass and the upstream zone (1*c*) of the head of the piston have a diameter which is smaller than said inner diameter of the internal ferrule (6).

6. The device according to claim 1 wherein the cylinder (2, 3) constitutes a barrel of a gun (8).

7. The device according to claim 6 wherein the power chamber has a furthest upstream zone, said zone has a chamber to accommodate a gas generating cartridge (9).

* * * * *